United States Patent [19]

Venardos et al.

[11] Patent Number: 4,585,063

[45] Date of Patent: Apr. 29, 1986

[54] OIL SHALE RETORTING AND RETORT WATER PURIFICATION PROCESS

[75] Inventors: Dean G. Venardos, Naperville; Colin G. Grieves, Oswego, both of Ill.

[73] Assignee: Standard Oil Company (Indiana), Chicago, Ill.

[21] Appl. No.: 656,012

[22] Filed: Sep. 27, 1984

Related U.S. Application Data

[62] Division of Ser. No. 368,976, Apr. 16, 1982, Pat. No. 4,495,056.

[51] Int. Cl.[4] ..... C10B 57/20; E21B 43/247; E21B 43/26; E21C 41/10

[52] U.S. Cl. ..... 166/259; 166/266; 166/267; 210/631; 299/2

[58] Field of Search ..... 166/259, 261, 265, 266, 166/267; 299/2; 208/11 R; 210/631

[56] References Cited

U.S. PATENT DOCUMENTS

| | | | |
|---|---|---|---|
| 2,789,083 | 4/1957 | Hardy | 208/177 X |
| 3,211,643 | 10/1965 | Lenhart | 208/177 |
| 4,066,538 | 1/1978 | Cines et al. | 210/631 X |
| 4,141,824 | 2/1979 | Smith | 210/631 X |
| 4,169,506 | 10/1979 | Berry | 299/2 X |
| 4,178,039 | 12/1979 | Burton, III | 299/2 |
| 4,207,179 | 1/1980 | McCarthy et al. | 210/631 X |
| 4,231,617 | 11/1980 | Larson et al. | 299/2 |
| 4,379,591 | 4/1983 | Tassoney | 299/2 |
| 4,415,442 | 11/1983 | Rhodes | 208/177 |
| 4,436,344 | 3/1984 | Forgac et al. | 166/261 X |
| 4,454,915 | 6/1984 | York et al. | 166/259 |

*Primary Examiner*—George A. Suchfield

*Attorney, Agent, or Firm*—Thomas W. Tolpin; William H. Magidson; William T. McClain

[57] ABSTRACT

An oil shale process is provided to retort oil shale and purify oil shale retort water. In the process, raw oil shale is retorted in an in situ underground retort or in an above ground retort to liberate shale oil, light hydrocarbon gases and oil shale retort water. The retort water is separated from the shale oil and gases in a sump or in a fractionator or quench tower followed by an API oil/-water separator. After the retort water is separated from the shale oil, the retort water is steam stripped, carbon adsorbed and biologically treated, preferably by granular carbon adsorbers followed by activated sludge treatment or by activated sludge containing powdered activated carbon. The retort water can be granularly filtered before being steam stripped. The purified retort water can be used in various other oil shale processes, such as dedusting, scrubbing, spent shale moisturing, backfilling, in situ feed gas injection and pulsed combustion.

17 Claims, 11 Drawing Figures

FEED GAS
FUEL GAS 32
30
34
36
58
62
66
GROUND LEVEL
14
16
38
BURNERS
72
SPENT SHALE
70
COMBUSTION ZONE
40
FLAME FRONT
68
RETORTED SHALE
42
RETORTING ZONE
26
12
10
22
64
48
54
GASES
18
50
56
44
52
OIL
WATER
60
46

OIL SHALE RETORTING AND RETORT WATER PURIFICATION PROCESS

CROSS REFERENCES TO RELATED APPLICATIONS

This application is a division of U.S. patent application, Ser. No. 368,976, filed Apr. 16, 1982, now U.S. Pat. No. 4,494,056, for an Oil Shale Retorting and Retort Water Purification Process.

BACKGROUND OF THE INVENTION

This invention relates to an oil shale process, and more particularly, to a process for retorting oil shale and purifying and recycling effluent oil shale retort water.

Researchers have now renewed their efforts to find alternative sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily useable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost 60 per cent located in the rich Green River oil shale deposits of Colorado, Utah and Wyoming. The remainder is contained in the linear Devonian-Mississippian black shale deposits which underline most of the eastern part of the United States.

As a result of dwindling supplies of petroleum and natural gas, extensive efforts have been directed to develop retorting processes which will economically produce shale oil on a commercial basis for these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist and liquid droplets of shale oil and light hydrocarbon gases such as methane, ethane, ethene, propane and propene, as well as other products such as oil shale retort water, hydrogen, nitrogen, carbon dioxide, carbon monoxide, ammonia and hydrogen sulfide. A carbon residue typically remains on the retorted shale.

In order to obtain high thermal efficiency in retorting, carbonate decomposition should be minimized. Carbonate decomposition consumes heat, lowers thermal efficiency and decreases the heating value of off gases. Colorado Mahogany zone oil shale contains several carbonate materials which decompose at or near the usual temperature attained when retorting oil shale. Typically, a 28 gallon per ton oil shale will contain about 23 per cent dolomite (a calcium/magnesium carbonate) and about 16 per cent calcite (calcium carbonate) or about 780 pounds of mixed carbonate minerals per ton. Dolomite requires about 500 BTU per pound and calcite about 700 BTU per pound for decomposition, a requirement that would consume about 8 per cent of the combustible matter of the shale if these minerals were allowed to decompose during retorting. Saline sodium carbonate minerals also occur in the Green River formation in certain areas and at certain stratigraphic zones.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen and oil shale, known as retorting, to form liberated hydrocarbons, can be done in in situ retorts underground or in surface retorts above ground. In principle, the retorting of oil shale comprises heating the oil shale to an elevated temperature and recovering the vapors and liberated effluent. However, as medium grade oil shale yields approximately 20 to 25 gallons of oil per ton of shale and significant quantities of oil shale retort water, the expense of materials handling and retort water treatment is critical to the economic feasibility of a commercial operation.

In in situ retorts, a flame front is continuously or intermittently passed through a bed of rubblized oil shale to liberate shale oil, off gases and oil shale retort water. There are two types of in situ retorts: true in situ retorts and modified in situ retorts. In true in situ retorts, the oil shale is explosively rubblized and then retorted. In a modified in situ retort, some of the oil shale is removed before explosive rubblization to create a cavity or a void space in the retorting area. A cavity provides extra space for rubblized oil shale. The oil shale which has been removed is conveyed to the surface and retorted above ground.

After an in situ retort is burned, the volume of spent shale within the retort is diminished and commonly does not adequately support the overlaying structure. This lack of support can lead to surface subsidence. Furthermore, spent in situ retorts can cave in if a new in situ retort is formed in an underground area closely adjacent the spent in situ retort. In order to increase the structural strength and integrity of the spent in situ retort, the spent retort can be backfilled with a slurry of spent oil shale and water.

In situ retorting and backfilling are described in U.S. Pat. Nos. 1,913,395; 1,191,636; 2,418,051; 3,001,776; 3,586,377; 3,434,757; 3,661,423; 3,951,456; 4,007,963; 4,017,119; 4,120,355; 4,126,180; 4,131,416; 4,133,380; 4,149,752; 4,194,788; 4,231,617 and 4,243,100 as well as in the patent application of John M. Forgac and Gerald B. Hoekstra for In Situ Retorting of Oil Shale with Pulsed Combustion, Ser. No. 265,687, filed May 20, 1981, now U.S. Pat. No. 4,436,344, which is assigned to the assignee of the present application.

In surface retorting, oil shale is mined from the ground, brought to the surface, crushed, sized and placed in a surface retort above ground where it is contacted with a hot heat transfer carrier, such as hot spent shale, sand, ceramic balls, metal balls or gases, or mixtures thereof for heat transfer. The resulting high temperatures cause the light hydrocarbon gases, shale oil and oil shale retort water to be liberated from the oil shale leaving a retorted, inorganic material and carbonaceous material such as coke. The carbonaceous material can be burned by contact with oxygen at oxidation temperatures to recover heat and to form spent shale relatively free of carbon. Spent oil shale which has been depleted in carbonaceous material is removed from the retort and reheated for use as heat carrier material or discarded. The liberated hydrocarbons and combustion gases are dedusted in cyclones, electrostatic precipitators, filters, desalters, water spray scrubbers or pebble beds.

Some well known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fusham (Manchuria), Union Rock Pump, gas combustion and fluid bed. Process heat requirements for surface retorting processes may be supplied either directly or indirectly.

The Lurgi-Ruhrgas process and modifications thereof are described in U.S. Pat. Nos. 3,655,518; 3,703,442; 3,962,043; 4,038,045 and 4,054,492 and in the articles by Marnell, P., entitled *Lurqi-Ruhrgas Shale Oil Process,* published in Hydrocarbon Processing, pages 269–271 (September 1976); Schmalfeld, I. P., *The Use of the Lurgi-Ruhgaras for the Distillation of Oil Shale,* Volume 70, Number 3, Quarterly of the Colorado School of Mines, pages 129–145 (July 1975); Rammler, R. W., *The Retortinq of Coal, Oil Shal and Tar Sand by Means of Circulated Fine-Grained Heat Carriers as a Preliminary Stage in the Production of Synthetic Crude Oil, Volume* 65, Number 4, Quarterly of the Colorado School of Mines, pages 141–167 (October 1970), and at pages 81–85 of the *Synthetic Fuels Data Handbook* by Cameron Engineers, Inc. (Second Edition 1978).

The Tosco II process and modifications thereof are described in U.S. Pat. Nos. 3,003,894; 3,034,979 and 3,058,903 and at pages 85–88 of the *Synthetic Fuels Data Handbook.*

The Union Rock Pump retorting process is described in U.S. Pat. Nos. 2,501,153; 2,640,019; 2,875,137; 2,881,117; 2,892,758; 2,954,328; 2,966,446; 2,989,442; 3,004,898; 3,039,939; 3,058,904; 4,003,797; 4,043,897 and 4,162,960 and at pages 95–100 of the *Synthetic Fuels Data Handbook.*

Various fluid bed retorting processes are described in U.S. Pat. Nos. 4,087,347; 4,125,453; 4,133,739; 4,157,245 and 4,199,432.

The Fusham process is shown and described at pages 101–102, in the book *Oil Shales and Shale Oils,* by H. S. Bell, published by D. Van Norstrand Company (1948). The other processes are shown and described in the *Synthetic Fuels Data Handbook.*

Significant quantities of oil shale retort water are produced during retorting. Oil shale retort water is laden with suspended and dissolved impurities, such as shale oil and oil shale particulates ranging in size from less than 1 micron to 1,000 microns and contain a variety of other contaminants not normally found in natural petroleum (crude oil) refinery waste water, chemical plant waste water or sewage. Oil shale retort water usually contains a much higher concentration of organic matter and other pollutants than other waste waters or sewage causing difficult disposal and purification problems.

The quantity of pollutants in water is often determined by measuring the amount of dissolved oxygen required to biologically decompose the waste organic matter in the polluted water. This measurement, called biochemical oxygen demand (BOD), provides an index of the organic pollution in the water. Many organic contaminants in oil shale retort water are not amenable to conventional biological decomposition. Therefore, tests such as chemical oxygen demand (COD) and total organic carbon (TOC) are employed to more accurately measure the quantity of pollutants in retort water. Chemical oxygen demand measures the amount of chemical oxygen needed to oxidize or burn the organic matter in waste water. Total organic carbon measures the amount of organic carbon in waste water.

Over the years, a variety of methods have been suggested for purifying or otherwise processing oil shale retort water. Such methods have included shale adsorption, in situ recycling, electrolysis, flocculation, bacteria treatment and mineral recovery. Typifying such methods and methods for treating waste water from refineries and chemical and sewage plants are those described in U.S. Pat. Nos. 2,948,677; 3,589,997; 3,663,435; 3,904,518; 4,043,881; 4,066,538; 4,069,148; 4,073,722; 4,124,501; 4,178,039; 4,121,662 and 4,289,578. These prior art methods have met with varying degrees of success.

It is therefore desirable to provide an improved process for retorting oil shale and purifying oil shale retort water.

SUMMARY OF THE INVENTION

A novel process is provided to retort oil shale and purify oil shale retort water. In the process, raw oil shale is retorted to liberate an effluent product stream of shale oil, light hydrocarbon gases and oil shale retort water. The raw oil can be retorted underground, in a modified or true in situ retort, or above ground in a surface retort, such as a fluid bed retort, a screw conveyor retort, a moving bed retort, a rotating pyrolysis drum retort or a rock pump retort.

The liberated oil shale retort water is formed from the thermal decomposition of kerogen during retorting. Water so formed is also referred to as "water of formation." Oil shale retort water can also be derived from in situ steam injection (process water), aquifers or natural underground streams in in situ retorts (aquifer water), and above ground and/or in situ shale combustion (water of combustion). Sizeable quantities of oil shale water are also produced during various auxiliary downstream shale oil processes, such as scrubbing, spraying, quenching, steam stripping, dedusting and desalting.

Raw oil shale water, however, if left untreated, is generally unsuitable for safe discharge into lakes and rivers or for use in downstream shale oil processes, because it contains a variety of suspended and dissolved pollutants, impurities and contaminants, such as raw, retorted and spent oil shale particulates, shale oil, grease, ammonia, phenols, sulfur, cyanide, lead, mercury and arsenic. Oil shale water is much more difficult to process and purify than waste water from natural petroleum refineries, chemical plants and sewage treatment plants, because oil shale water generally contains a much greater concentration of suspended and dissolved pollutants which are only partially biodegradable. For example, untreated retort water contains over 10 times the amount of total organic carbon and chemical oxygen demand, over 5 times the amount of phenol and over 200 times the amount of ammonia as waste water from natural petroleum refineries.

In the process of this invention, raw oil shale water is purified and treated so that it is environmentally suitable for discharge into lakes and rivers. Virtually all of the oil shale particulates, shale oil, phenols, ammonia, total organic carbon and chemical oxygen demand in the raw oil shale water are removed by this novel process. Substantial amounts of other contaminants are also removed from the oil shale by this process.

Retorting and processing efficiency can be increased by using the purified oil shale water for dedusting, steam stripping, scrubbing, spent shale moisturizing, steam generation, in situ steam injection, and/or pulsed combustion. The purified retort water can also be used in cementatious slurry backfilling of spent oil shale retorts to enhance the structural strength and integrity of the spent retort to permit the formation of a new in situ retort in an adjacent underground area.

In the process of this invention, raw oil shale water is separated from shale oil and gases and optionally granularly filtered before being steam stripped, carbon adsorbed and biologically treated. Separation can be at least partially attained by sedimentation in a sump or an API oil/water separator, and can be enhanced by fractionation, in a fractionator, quench tower or scrubber, as well as by clarification or air flotation.

In the preferred form, oil shale water is biologically treated in a tank of activated sludge. Microorganisms in the sludge consume and degrade substantial amounts of contaminants in the oil shale water. Biological treatment can also be accomplished with a fixed-film process, such as a rotating biological contactor, or by an anaerobic process.

Carbon adsorption can be attained by passing the stripped shale water through one or more granular activated carbon adsorbers before biological treatment. Various granular activated carbon adsorbers can be used such as expanded bed adsorbers, moving or pulsed bed adsorbers, upflow adsorbers and downflow adsorbers. Carbon adsorption can also be accomplished concurrently with biological treatment, by passing the stripped shale water through a tank of powdered activated carbon and activated sludge.

As used in this application, the terms "oil shale water" and "shale water" mean water and/or water vapor (steam) which have been emitted during retorting of raw oil shale and/or from processing of shale oil.

The terms "retort water" and "oil shale retort water" mean water and/or water vapor (steam) which have been emitted during retorting of raw oil shale.

The term "shale oil" means oil which has been obtained from retorting raw oil shale.

The term "retorted oil shale" as used herein means raw oil shale which has been retorted to liberate shale oil, light hydrocarbon gases and retort water, leaving organic material containing residual carbon.

The term "spent oil shale" as used herein means retorted oil shale from which substantially all the residual carbon has been removed by combustion.

The term "oil shale particulates" as used herein includes particulates of raw, retorted and spent oil shale ranging in size from less than 1 micron to 1,000 microns.

The terms "dedusting" and "dedust" as used herein mean the removal of a substantial amount of oil shale particulates from shale oil.

The term "desalter" as used herein means an apparatus which is conventionally used for desalting petroleum (crude oil), but which is specifically used in this invention for dedusting shale oil.

The abbreviation "GAC" as used herein means granular activated carbon.

The abbreviation "PAC" as used herein means powdered activated carbon.

The abbreviation "TOC" as used herein means total organic carbon.

The abbreviation "DOC" as used herein means dissolved organic carbon.

The abbreviation "COD" as used herein means chemical oxygen demand.

The abbreviation "SCOD" as used herein means soluble chemical oxygen demand.

The abbreviation "API" as used herein means American Petroleum Institute.

The abbreviation "ppm" as used herein means parts per million.

A more detailed explanation of the invention is provided in the following description and appended claims taken in conjunction with the accompanying drawings.

DETAILED DESCRIPTION OF THE PREFERRED EMBODIMENTS

Figure 1:
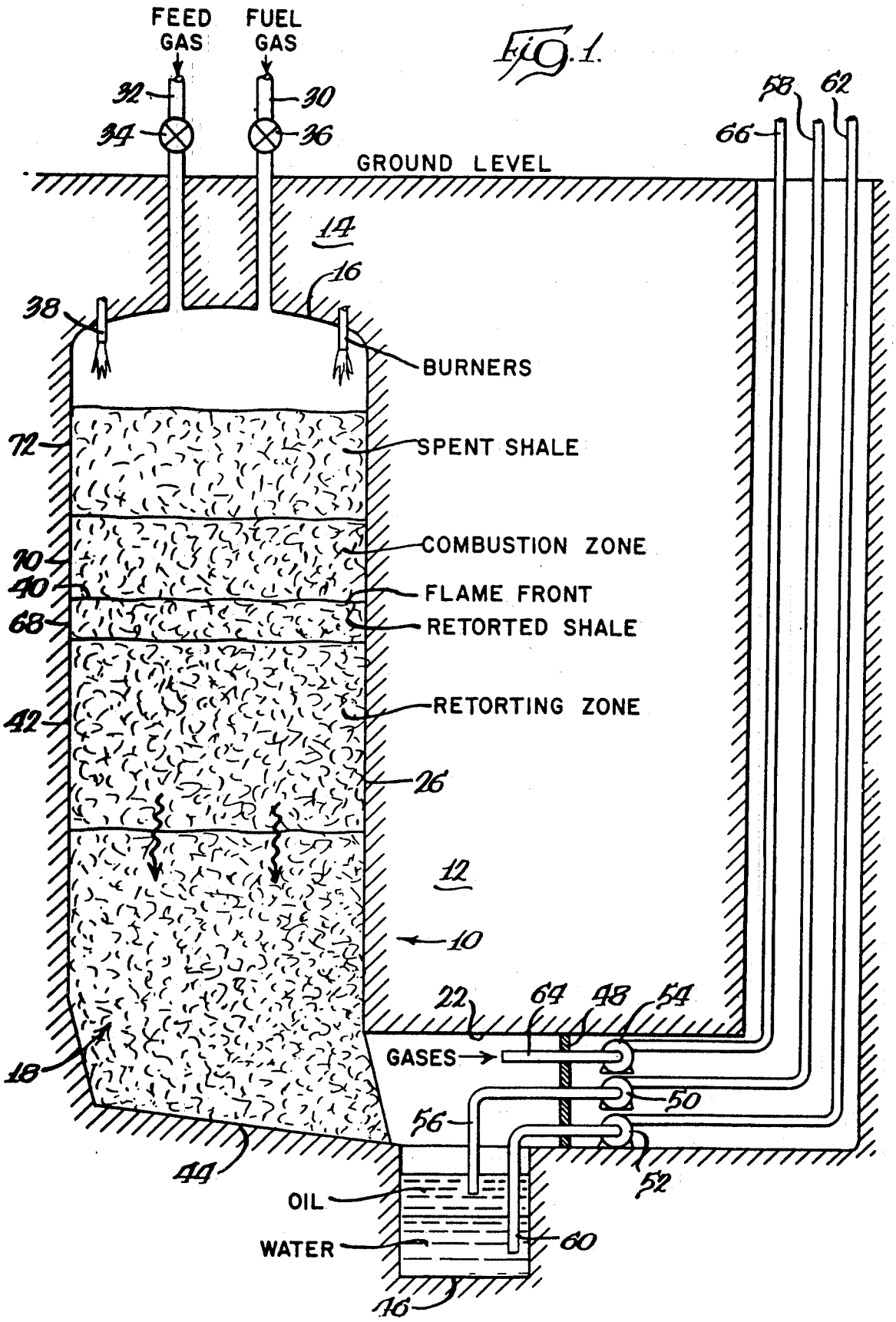
FIG. 1 is a schematic cross-sectional view of an in situ retort, for retorting oil shale in accordance with principles of the present invention.

Referring now to FIG. 1 of the drawings, an underground, modified in situ, oil shale retort 10 located in a subterranean formation 12 of oil shale is covered with an overburden 14. Retort 10 is elongated, upright and generally box-shaped with a top or dome-shaped roof 16.

Retort 10 is substantially filled with a fluid permeable, rubblized mass or bed 18 of different sized, raw oil shale fragments. The rubblized mass is formed by first mining an access tunnel or drift 22 extending horizontally into the bottom of retort 10 and removing from 2 percent to 40 percent and preferably from 15 percent to 25 percent by volume of the oil shale from a central region of the retort to form a cavity or void space. The removed oil shale is conveyed to the surface and retorted in an aboveground surface retort. The mass of oil shale surrounding the cavity is then fragmented and expanded by detonation of explosives to form the rubblized mass 18.

Conduits or pipes 30 and 32 extend from above ground level through overburden 13 into the top 16 of retort 10. Pipes 30 and 32 include ignition fuel line 30 and feed gas line 32. The extent and rate of gas flow through lines 30 and 32 are regulated and controlled by valves 34 and 36, respectively. Burners 38 are located in proximity to the top of the bed 18.

In order to commence retorting of the rubblized mass 18 of oil shale, a liquid or gaseous fuel, preferably a combustion ignition gas or fuel gas, such as recycled off gases or natural gas, is fed into retort 10 through fuel line 30 and an oxygen-containing flame front-sustaining, feed gas, such as air, is fed into the retort 10 through feed gas line 32. Burners 38 are then ignited to establish a flame front 40 horizontally across the bed 18. If economically feasible or otherwise desirable, the rubblized mass 18 of oil shale can be preheated to a temperature slightly below its retorting temperature with an inert preheating gas, such as vaporized purified retort water which has been treated in accordance with the water treatment process described below, or with nitrogen or off gases emitted from the retort, before introduction of feed gas and ignition of the flame front. After ignition, fuel valve 36 is closed to shut off inflow of fuel gas. Once the flame front is established, residual carbon contained in the oil shale usually provides an adequate source of fuel to maintain the flame front as long as the feed gas is supplied to the flame front.

The oxygen-containing feed gas supports and drives the flame front 40 downwardly through the bed 18 of oil shale. The feed gas can be air, air enriched with oxygen, air diluted with recycled off gas or air diluted with vaporized purified retort water which has been treated in accordance with the water treatment process described below, as long as the feed gas has from 5 percent to less than 90 percent and preferably from 10 percent to 30 percent and most preferably a maximum of 20 percent by volume molecular oxygen. The oxygen content of the feed gas can be varied throughout the process.

Flame front 40 emits combustion off gases and generates heat which moves downwardly ahead of the flame front and heats the raw, unretorted oil shale in retorting zone 42. During retorting, hydrocarbons and oil shale retort water vapors are liberated from the raw oil shale. The hydrocarbons are liberated as a gas, vapor or liquid droplets and most likely a mixture thereof and include normally liquid shale oil and light hydrocarbon gases, such as methane, ethane, ethene, propane and propene. The shale oil and retort water flow downwardly by gravity and condense and liquefy upon the cooler, unretorted raw oil shale below the retorting zone, forming condensates which percolate downwardly through the retort into access tunnel 22.

Off gases emitted during retorting include various amounts of hydrogen, carbon monoxide, carbon dioxide, ammonia, hydrogen sulfide, carbonyl sulfide, oxides of sulfur and nitrogen, oil shale retort water vapor and low molecular weight hydrocarbons. The composition of the off gases is dependent on the composition of the feed gas.

The effluent product stream of condensate (liquid shale oil and oil shale retort water) and off gases flow downwardly to the sloped bottom 44 of retort 10 and then into a collection basin and gravity separator 46, also referred to as a "sump" in the bottom of access tunnel 22. Concrete wall 48 prevents leakage of off gas into the mine. The liquid shale oil, retort water and gases are separated by sedimentation or gravity separation in sump 46 and pumped to the surfaces by pumps 50, 52 and 54, respectively, through inlet and return lines 56, 58, 60, 62, 64 and 66, respectively.

Raw off gases can be recycled as part of the fuel gas and/or feed gas, either directly or after the water vapors and shale oil vapors have been stripped away in a quench tower or scrubber with a spray of purified retort water which has been treated in accordance with the water treatment process described below.

During retorting, retorting zone 40 moves downward leaving a layer or band 68 of retorted shale containing residual carbon. Retorted shale layer 68 above retorting zone 42 defines a retorted zone which is located between retorting zone 42 and the flame front 40 of combustion zone 70 leaving spent, combusted oil shale in a spent shale zone 72.

In order to assure a more uniform flame front 40 across retort 10, the oxygen-containing feed gas can be intermittently fed into retort 10 in pulses by repetitively starting and stopping the influx of feed gas with control valve 34 to alternately ignite and quench flame front 40 for selected intervals of time. In such circumstances, a purge gas such as purified retort water vapors which have been treated in accordance with the water treatment process described below, are injected between pulses into combustion zone 70 through feed gas line 32 or a separate purge gas line. The purge gas extinguishes flame front 40 and accelerates transfer of sensible heat from combustion zone 70 to retorting zone 42. During purging, i.e., between pulses of feed gas, retorting of oil shale continues. The purge gas enhances the rate of downward advancement of retorting zone 40 to widen the gap and separation between the leading edge or front of retorting zone 42 and the combustion zone 70. Purging also thickens the retorted shale layer 68 and enlarges the separation between retorting zone 42 and combustion zone 70. The enlarged separation minimizes losses from oil burning upon reignition which occurs when the next pulse of feed gas is injected. The combustion zone 70 can be cooled to a temperature as low as 650° F. by the purge gas and still have successful ignition with the next pulse of feed gas.

The injection pressure of the feed gas, purge gas, and fuel gas is from one atmosphere to five atmospheres, and most preferably two atmospheres. The flow rate of the feed gas, purge gas and fuel gas are each a maximum of 10 SCFM/ft.$^2$, preferably from 0.01 SCFM/ft$^2$ to 6 SCFM/ft$^2$, and most preferably from 1.5 SCFM/ft$^2$ to 3 SCFM/ft$^2$. The duration of each pulse of feed gas and purge gases from 15 minutes to one month, preferably from 1 hour to 24 hours and most preferably from 4 hours to 12 hours. The time ratio of purge gas to feed gas is from 1:10 to 10:1 and preferably from 1:5 to 1:1.

Oil shale retort water is laden with suspended and dissolved impurities including shale oil and particulates of raw, retorted and/or spent oil shale ranging in size from less than 1 micron to 1,000 microns as well as a variety of other impurities as explained below. The amount and proportion of the shale oil, oil shale particulates and other impurities depend upon the richness and composition of the oil shale being retorted, the composition of the feed gas and retorting conditions. One sample of retort water from a modified in situ retort had a pH of 8.9 to 9.1 and an alkalinity of 12,000 mg/, and contained 1,800 mg/ total organic carbon, 7,000 mg/ chemical oxygen demand, 15,000 mg/ total solids, 1,600 mg/ ammonia, 6,000 mg/ sodium, 7 mg/ magnesium and 5 mg/ calcium.

Three other test samples of oil shale retort water from a modified, in situ retort has the following composition:

| | Test 1 | Test 2 | Test 3 |
|---|---|---|---|
| COD, mg/l | 11174 | 13862 | 10140 |
| Phenols, mg/l | 29 | 30 | 30 |
| Total dissolved solids, mg/l | 3159 | 2151 | 1099 |
| Total suspended solids, mg/l | 718 | 435 | 10.8 |
| Organic C, ppm | 6660 | 5640 | 4220 |
| Inorganic C, ppm | 1520 | 1600 | 4120 |
| $NH_3$, ppm | 1150 | 6000 | 690 |
| Cu, ppm | <0.05 | <0.05 | <0.05 |
| $F^-$, ppm | 2 | 3 | 1 |
| N, ppm | 5200 | 4700 | 6970 |
| Ni, ppm | 0.38 | 0.53 | 0.30 |
| P, ppm | 3 | <1 | 852 |
| S, % | 0.05 | 0.05 | 0.04 |
| Zn, ppm | 0.05 | 0.08 | 0.08 |
| $CN^-$, ppm | <.01 | <.01 | 0.41 |
| Ag, ppm | <0.05 | <0.05 | <0.05 |
| As, ppm | 1.06 | 0.47 | 0.5 |

Another test sample of oil shale retort water from a modified in situ retort has the following composition:

| | |
|---|---|
| $HCO_3$ | 668 mg/l |
| SCOD | 1249 mg/l |
| TOTAL ALKALINITY | 1164 mg/l |
| N (TOTAL) | 540 mg/l |
| $NH_3$ | 392 mg/l |
| $NO_3$ | .41 mg/l |
| F | 1.29 mg/l |
| S | 53.0 mg/l |
| TOC | 281 mg/l |
| PHENOL | 14.2 mg/l |
| Shale oil and grease | 106 mg/l |
| As | .133 mg/l |
| B | .23 mg/l |
| $SO_4$ | 1916 mg/l |
| $S_2O_3$ | 426 mg/l |
| SCN | 0.17 mg/l |
| CN | <.05 mg/l |
| pH | 8.7 |
| ORGANIC-N | 80.8 mg/l |
| TRACE ELEMENTS | |
| Ba | <.1 mg/l |
| Cd | <.01 mg/l |
| Cr | <.01 mg/l |
| Cu | <.01 mg/l |
| Pb | <.05 mg/l |
| Hg | <.0003 mg/l |
| Mo | 0.9 mg/l |
| Sc | <.05 mg/l |
| Ag | <.01 mg/l |
| Zn | <.01 mg/l |

Figures 2, 3, 4, 5, 6:
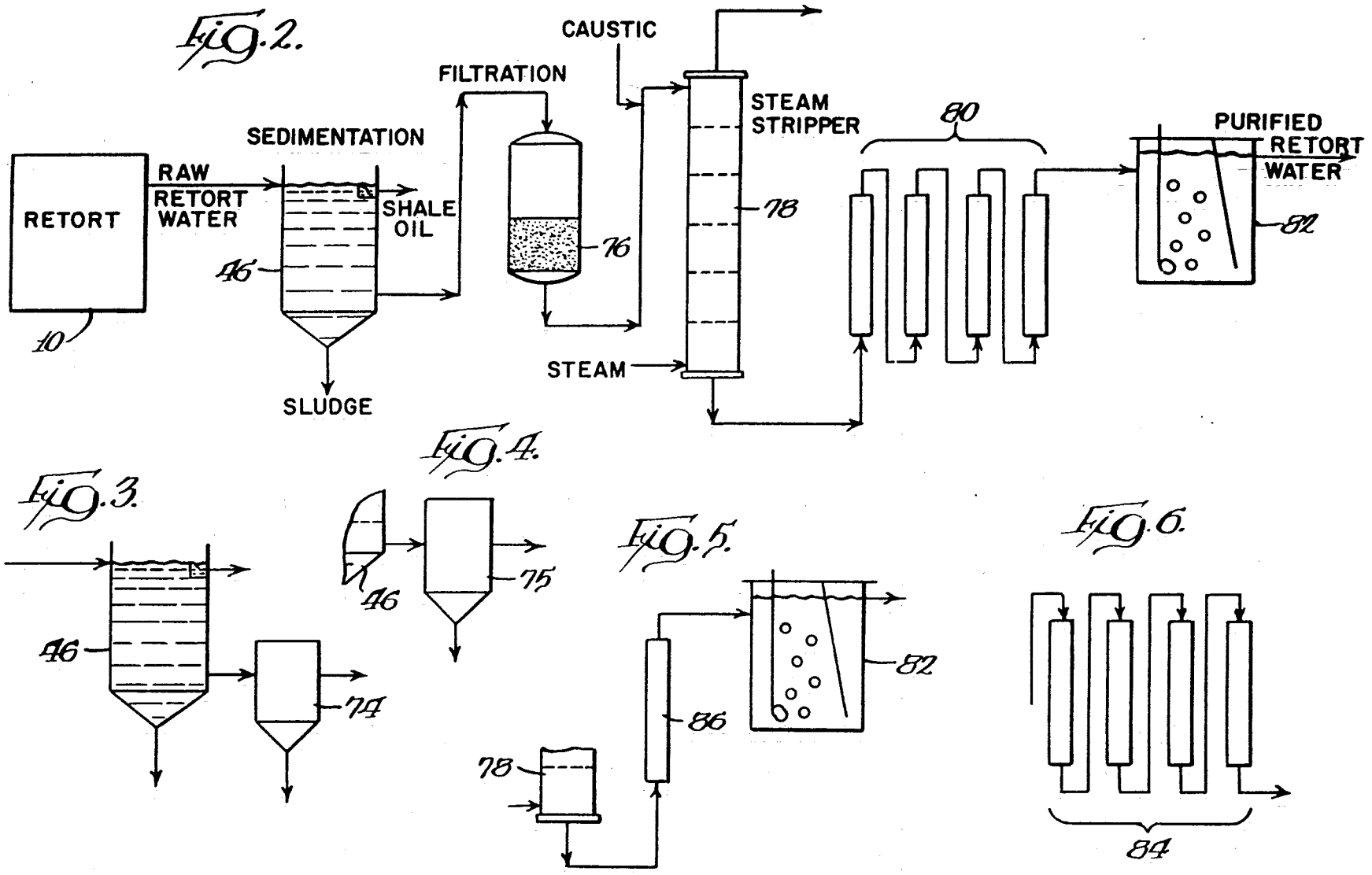
FIG. 2 is a schematic flow diagram of an in situ retorting and GAC, retort water purification process in accordance with principles of the present invention.
FIG. 3 is a schematic flow diagram of part of a retort water purification process in accordance with principles of the present invention.
FIG. 4 is a schematic flow diagram of part of another retort water purification process in accordance with principles of the present invention.
FIG. 5 is a schematic flow diagram of part of still another GAC, retort water purification process in accordance with principles of the present invention.
FIG. 6 is a schematic flow diagram of part of a further GAC, retort water purification process in accordance with principles of the present invention.

As shown in FIG. 2, oil shale retort water from modified in situ retort 10 is separated from shale oil and gases by sedimentation in an underground sump or separator 46 (FIGS. 1 and 2) before being pumped to the surface. Further oil/water separation can be accomplished above ground by passing the retort water through a clarifier 74 (FIG. 3) at atmospheric pressure from 30 minutes to 4 hours or through an air flotation unit 75 (FIG. 4) from 30 minutes to 2 hours. The air flotation unit is more efficient than the clarifier since it is able to separate the oil and water in about one-half the time of clarification.

After the retort water has been separated from the shale oil and gases, the processed retort water is filtered in a granular filter, such as in a sand filter 76 (FIG. 2) from atmospheric pressure to 7 psig. Filter 76 removes most of the untrapped, free shale oil and a substantial amount of the oil shale particulates from the retort water. The flow rate of retort water passing through filter 76 is from 1 gal/min/ft$^2$ to 20 gal/min/ft$^2$ and preferably, from 3 gal/min/ft$^2$ to 6 gal/min/ft$^2$ for best results.

The filtered oil shale water is passed through a steam stripper 78 (FIG. 2) at atmospheric pressure to 100 psig and preferably at 20 psig for more effective stripping. In the preferred arrangement, steam is injected upwardly into steam stripper 78 and retort water is fed downwardly into the stripper so that the steam and stripped impurities flow upwardly in the stripper and the retort water flows downwardly in the stripper, in countercurrent relationship to each other. From 0.1 to 3.0 lbs of steam are injected for each gallon of influent retort water. Steam stripper 78 removes from 90% to 100%, preferably at least 98% and most preferably at least 99% by weight of the ammonia from the retort water. Stripper 78 also removes from 5% to 50% and preferably at least 20% by weight of the total organic carbon, of the dissolved organic carbon and of the chemical oxygen demand from the retort water. Steam stripper 78 also removes from 50% to 99% and preferably at least 80% by weight of the carbonates from the retort water. Stripper 78 further removes from 1% to 60% and preferably at least 30% by weight of the phenols. In one test stripper 78 also removed 23% of the sulfur from the retort water. Caustic can be added to steam stripper 78 to raise the pH of the retort water, such as to 9.5.

In the process of FIG. 2, the steam stripped water is carbon-adsorbed and biologically treated by passing the steam stripped water through a series of four moving bed or pulsed bed granular activated carbon adsorbers 80 and then through a tank 82 of activated sludge. Retort water is sequentially fed into the bottom of the moving or pulsed bed adsorbers and exits the top of the adsorbers. Fresh carbon is added to the top of the adsorbers. Moving and pulse bed, granular activated carbon adsorbers allow generally continuous withdrawal of spent carbon while fresh carbon is added.

Other types of granular activated carbon adsorbers (GAC) can be used in lieu of or in combination with the moving or pulsed carbon adsorbers 80 shown in FIG. 2, such as downflow granular activated carbon adsorbers 84 (FIG. 6), upflow granular activated carbon adsorbers (schematically similar to 80, FIG. 2) and expanded bed granular activated carbon adsorbers (also schematically similar to 80, FIG. 2) to reduce plugging and fouling. Instead of using a series of granular activated carbon adsorbers, a single granular activated carbon adsorber 86 (FIG. 5) can be used, such as in a single moving bed or pulsed bed, granular activated carbon adsorber, a single expanded bed granular activated carbon adsorber or a single upflow or downflow, granular activated carbon adsorber.

The series of granular activated carbon adsorbers 80 and 84 shown in FIGS. 2 and 6, respectively, remove from 50% to 90% by weight of the remaining total organic carbon, dissolved organic carbon and chemical oxygen demand as well as 90% to 100% by weight of the remaining phenols of the steam stripped retort water. Adsorbers 80 and 84 also remove from 0.1 to 1.5 and preferably 0.4 grams total organic carbon per gram of carbon.

The enlarged capacity single, granular activated carbon adsorber 86 (FIG. 5) removes from 40% to 80% and preferably at least 66.7% by weight of the remaining total organic carbon, dissolved organic carbon and chemical oxygen demand from the steam stripped retort water.

The empty bed residence time for the carbon adsorption units 80, 84 and 86 shown in FIGS. 2, 5 and 6 are from 10 minutes to 3 hours and preferably about 1 hour. The hydraulic surface loading and linear flow rate across granular carbon adsorber units 80, 84 and 86 (FIGS. 2, 5 and 6) are from 0.1 gal/min/ft$^2$ to 7.0 gal/min/ft$^2$ and preferably at least 4.0 gal/min/ft$^2$ for most effective granular carbon adsorption.

Granular activated carbon (GAC) is a carbonaceous material originating from coal, wood, peat, nut shells, petroleum coke, etc. The process of activation begins with dehydration and carbonization of the raw material by slow heating in the absence of air. The actual process of activation usually is accomplished by steaming at high temperatures to oxidize decomposition products, leaving behind a complex highly porous structure with measured surface areas as high as 1,400 m$^2$/g. It is this mass of surface area, combined with favorable surface chemistry, which allows active carbon to adsorb organic compounds in aqueous solutions. Adsorption of organics on carbon continues until reaching an equilibrium. At equilibrium, either the granular activated carbon is discarded and replaced with fresh carbon or the organics can be driven off by regeneration, and the carbon returned for further use.

The preferred method of regenerating granular activated carbons is by thermal treatment. In the regeneration process spent granular activated carbon is dewatered by gravity and fed to a furnace where the granular carbon adsorber is heated and dried. Radiant heat in the furnaces raises the carbon temperature through several gradual heating zones until a temperature in excess of 1,600° F. is reached. By maintaining an inert atmosphere, the adsorbed organics are driven off and purged by steam generated in the drying zones. Steam enhances reactivation of the carbon pore structure. After the carbon adsorber is heated and reactivated, it is cooled and quenched in a water bath. From 70% to 90% and preferably from 75% to 80% of the spent granular carbon adsorber can be reactivated by such regeneration techniques.

In a test that measured the amount of impurities removed by a series of GAC adsorbers from steam stripped retort water, 79% by weight of the total organic carbon and dissolved organic carbon and 74% by weight of the soluble chemical oxygen demand were removed. The influent steam stripped retort water entering the first GAC adsorber contained 236 mg/l total organic carbon, 223 mg/l dissolved organic carbon and 1010 mg/l soluble chemical oxygen demand. Steam stripped retort water exiting the first GAC adsorber contained 123 mg/l total organic carbon, 139 mg/l dissolved organic carbon and 622 mg/l soluble chemical oxygen demand. Steam stripped retort water exiting the second GAC adsorber contained 85 mg/l total organic carbon, 82.6 mg/l dissolved organic carbon and 398 mg/l soluble chemical oxygen demand. Steam stripped retort water exiting the third GAC adsorber contained 68.7 mg/l total organic carbon, 60.6 mg/l dissolved organic carbon and 334 mg/l soluble chemical oxygen demand. The effluent steam stripped retort water exiting the fourth GAC adsorber contained 49.8 mg/l total organic carbon, 45.9 mg/l dissolved organic carbon and 264 mg/l soluble chemical oxygen demand.

In a test that measured the amount of impurities removed from steam stripped retort water in a single GAC adsorber, 72% by weight of the total organic carbon, 69% by weight of the dissolved organic carbon and 57% by weight of the soluble chemical oxygen demand were removed. The influent stripped water entering the GAC adsorber contained 236 mg/l total organic carbon, 223 mg/l dissolved organic carbon and 1010 mg/l soluble chemical oxygen demand. Retort water exiting the GAC adsorber contained 66.3 mg/l of total organic carbon, 71.6 mg/l dissolved organic carbon and 438 mg/l soluble chemical oxygen demand. In this test, the single GAC adsorber was regenerated when the effluent chemical oxygen demand was 50% of the influent chemical oxygen demand.

In the processes of FIGS. 2 and 5, the activated sludge tank 82 operates at atmospheric pressure with a solids (sludge) residence time of from 1 day to 100 days and preferably from 25 to 30 days. The hydraulic residence time of the retort water passing through the activated sludge tank is from 4 hours to 36 hours and preferably 16 hours for most efficient biological treatment.

Activated sludge tank 82 (FIG. 2) contains an aeration chamber and a clarifier chamber. In the aeration chamber, air bubbles are rapidly circulated through the retort water. Microorganisms degrade, consume and digest the biodegradable contaminants in the retort water. In the clarifier chamber, the effluent retort water flows over one or more weirs and is separated from the microorganisms. The microorganisms are recycled back to the aeration tank. Activated sludge biological treatment in tank 82 (FIG. 2) removes from the GAC adsorbed retort water, from 65% to 99% and preferably at least 85% to 90% by weight of the remaining total organic carbon, dissolved organic carbon and chemical oxygen demand as well as from 30% to 95% and preferably at least 70% by weight of the remaining ammonia.

Overall, the retort water purification processes shown in FIGS. 2–6 remove from the untreated raw oil shale retort water, 85% to 99% and preferably at least 95% of the total organic carbon and dissolved organic carbon, from 85% to 99% and preferably at least 98% of the chemical oxygen demand and from 90% to 99% and preferably at least 98% of the total nitrogen, ammonia and phenols, to substantially purify the retort water.

While activated sludge is the preferred biological treatment for most effective purification, in some circumstances it may be desirable to use other types of biological treatment, such as anaerobic processes, packed beds, digesters, fixed-film processes such as biodiscs and other rotating biological contactors, etc.

The amount of impurities removed by activated sludge tank 82 (FIG. 2) from multiple GAC adsorbed retort water is dependent upon the hydraulic residence times, as shown from the following tests.

| | Test 1 | Test 2 |
|---|---|---|
| Hydraulic residence time | 12 hours | 24 hours |
| Sludge age | 25 days | 25 days |
| Aeration volume | 15 liters | 15 liters |
| Total nitrogen removed | 53% | 74% |

-continued

| | Test 1 | Test 2 |
|---|---|---|
| Ammonia removed | 71% | 85% |
| Total organic carbon removed | 61% | 73% |
| Dissolved organic carbon removed | 77% | 85% |
| Soluble chemical oxygen demand removed | 90% | 89% |
| Boron removed | 33% | 29% |

The amount of impurities removed by activated sludge tank 82 (FIG. 5) from single GAC adsorbed retort water is similarly dependent upon the hydraulic residence times, as shown from the following tests:

| | Test 1 | Test 2 |
|---|---|---|
| Hydraulic residence time | 12 hours | 24 hours |
| Sludge age | 25 days | 25 days |
| Aeration volume | 15 liters | 15 liters |
| Total nitrogen removed | 35% | 58% |
| Ammonia removed | 48% | 71% |
| Total organic carbon removed | 63% | 64% |
| Dissolved organic carbon removed | 72% | 76% |
| Soluble chemical oxygen demand removed | 86% | 88% |
| Boron removed | 27% | 16% |

Figure 7:
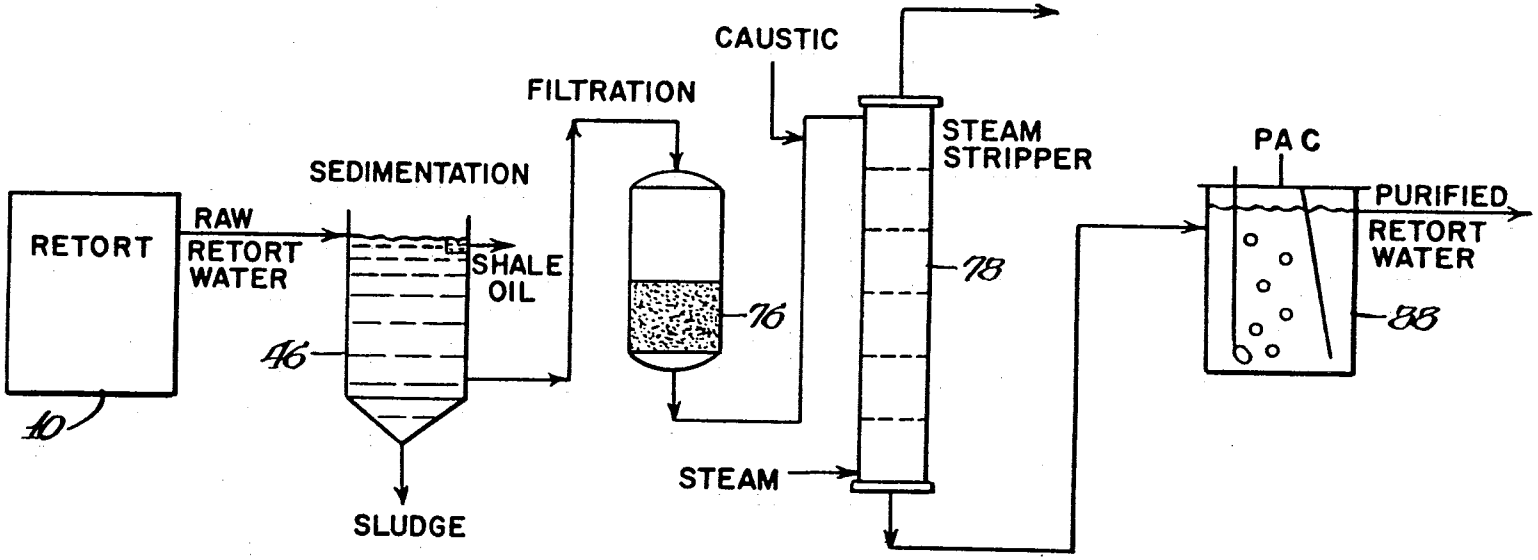
FIG. 7 is a schematic flow diagram of an in situ retorting and PAC, retort water purification process in accordance with principles of the present invention.

Carbon adsorption and biological treatment can be combined in a tank 88 containing powdered activated carbon (PAC) and activated sludge as shown in FIG. 7. Powdered activated carbon and activated sludge tank 88 is operated at atmospheric pressure with a mixed liquor carbon concentration from 1 g/l to 20 g/l and preferably at 10 g/l. The solids residence time of the activated sludge, microorganisms and activated carbon in tank 88 is from 1 day to 150 days and preferably around 50 days for efficient powdered activated carbon adsorption and biological treatment. The hydraulic residence time of the retort water passing through tank 88 is from 4 hours to 72 hours and preferably around 48 hours for efficient retort water purification.

PAC tank 88 (FIG. 7) removes from the steam stripped retort water, from 85 to 90% and preferably at least 90% of the remaining total organic carbon, dissolved organic carbon and chemical oxygen demand as well as from 85% to 99% and preferably at least 98% by weight of the remaining phenols and from 40% to 95% and preferably at least 70% by weight of the remaining ammonia.

Overall, the retort water purification process shown in FIG. 6 removes from the untreated, raw oil shale retort water, from 85% to 99% and preferably at least 96% of the total organic carbon and dissolved organic carbon, from 80% to 98% and preferably at least 92% by weight of the chemical oxygen demand and from 90% to 99% and preferably at least 98% of the total nitrogen, ammonia and phenols, so as to substantially purify the oil shale retort water.

In the process of FIG. 7, the sedimentation step can optionally include clarification as shown in FIG. 3 or air flotation as shown in FIG. 4. A chemical flocculant can also be added before sedimentation and filtration in the processes of FIGS. 2–6.

The amount of impurities removed by PAC tank 88 (FIG. 7) from steam stripped retort water is dependent upon the mixed liquor carbon concentration, as shown in the following tests:

| | Test 1 | Test 2 |
|---|---|---|
| Mixed liquor carbon concentration | 5 g/l | 10 g/l |
| Sludge age | 25 days | 25 days |
| Hydraulic residence time | 48 hours | 48 hours |
| Aeration volume | 15 liters | 15 liters |
| Total nitrogen removed | 70% | 83% |
| Organic nitrogen removed | 71% | 81% |
| Ammonia removed | 66% | 84% |
| Total organic carbon removed | 82% | 89% |
| Dissolved organic carbon removed | 84% | 90% |
| Phenols removed | 98% | 98% |
| Soluble chemical oxygen demand | 89% | 93% |
| Boron removed | 0% | 20% |
| Sulfur removed | 89% | 93% |

If desired, steam stripped retort water can undergo activated sludge biological treatment by passing the steam stripped water through an activated sludge tank alone, without PAC and without being preceded by GAC adsorption. Such treatment can be optionally *followed* by GAC adsorption, in one or more GAC adsorbers. While such processes are effective in removing many impurities, they do not attain the desired amount of water purification achieved by the GAC and PAC processes of FIGS. 2–7.

Activated sludge biological treatment alone (without PAC and without being preceded or followed by GAC adsorption) removes a substantially smaller amount of chemical oxygen demand and ammonia than do the GAC and PAC processes of FIGS. 2–7. Activated sludge biological treatment followed by GAC adsorption removes a substantially smaller amount of ammonia than do the GAC and PAC processes of FIGS. 2–7. The GAC processes of FIGS. 2, 5 and 6 and the PAC process of FIG. 7 can remove from steam stripped retort water as much as 15 times and 7 times, respectively, the amount of soluble chemical oxygen demand and as much as 5 times the amount of ammonia as activated sludge biological treatment alone (without PAC and without being preceded or followed by GAC adsorption). The GAC processes of FIG. 2, 5 and 6 and the PAC process of FIG. 7 can remove as much as five times the amount of ammonia from steam stripped retort water, than activated sludge biological treatment followed by GAC adsorption.

The amount of impurities removed from a test sample of steam stripped retort water by activated sludge biological treatment alone (without PAC and without being preceded or followed by GAC adsorption) and by activated sludge biological treatment followed by GAC adsorption, were as follows:

| | Test 1 Activated Sludge Biological Treatment Alone | Test 2 Activated Sludge Biological Treatment Followed By GAC Adsorption |
|---|---|---|
| Hydraulic residence time | 48 hours | 48 hours |
| Sludge age | 50 days | 50 days |
| Aeration volume | 15 liters | 15 liters |
| Total nitrogen | 11% | 50% |

-continued

| | Test 1 Activated Sludge Biological Treatment Alone | Test 2 Activated Sludge Biological Treatment Followed By GAC Adsorption |
|---|---|---|
| removed | | |
| Organic nitrogen removed | 5% | 58% |
| Ammonia removed | 5% | 9% |
| Total organic carbon removed | 44% | 63% |
| Dissolved organic carbon | 42% | 71% |
| Phenols removed | 98% | — |
| Soluble chemical oxygen demand removed | 54% | 74% |
| Boron removed | 0% | 14% |
| Sulfur removed | 90% | 90% |

Figure 8:
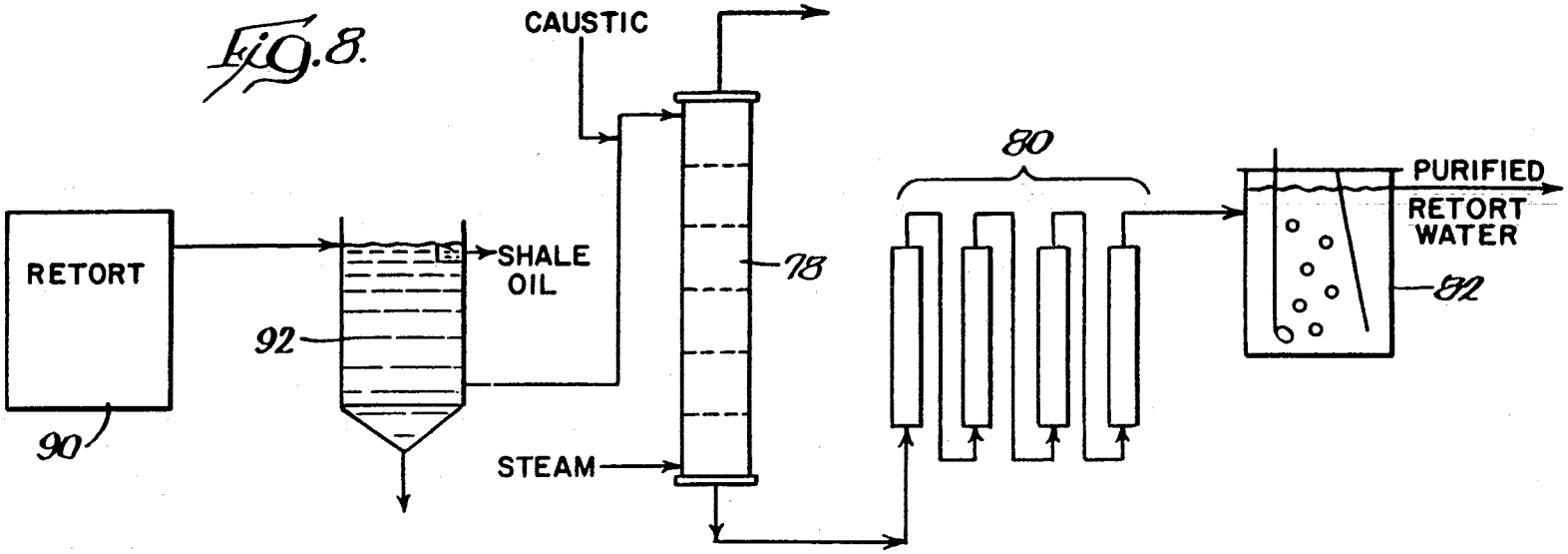
FIG. 8 is a schematic flow diagram of a surface retorting and GAC, retort water purification process in accordance with principles of the present invention.
Figure 9:
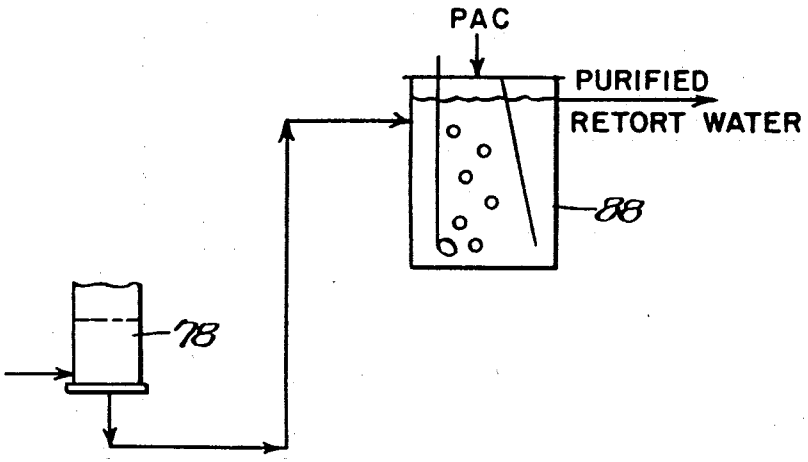
FIG. 9 is a schematic flow diagram of part of a surface retorting and PAC, retort water purification process in accordance with principles of the present invention.

The oil shale retorting and GAC retort water purification process shown in FIG. 8 and the oil shale retorting and PAC retort water purification process shown in FIG. 9 are substantially similar to the oil shale retorting and GAC and PAC retort water purification processes shown in FIGS. 2 and 7, respectively, except that retorting occurs in an above ground surface retort 90, such as a fluid bed retort, moving bed retort, screw conveyor retort, rotating pyrolysis drum retort or rock pump retort. Oil/water separation (sedimentation/gravity separation) is preferably carried out in an API separator 92, also referred to as "API oil/water separation," instead of a sump with optional clarification or air flotation as shown in FIGS. 3 and 4. Granular filtration, as shown in FIGS. 2 and 7, is also optional. The amount of oil shale particulates, shale oil and other impurities removed from the oil shale retort water by the GAC and PAC water treatment processes of FIGS. 8 and 9 are in the same general ranges as described above with respect to the processes of FIGS. 2–7. GAC absorbers 80 (FIG. 8) can be of the type shown in FIGS. 2 and 6 or can be a single GAC adsorber as shown in FIG. 5.

In the preferred method of above ground retorting, raw oil shale is crushed, sized and sorted by conventional crushing equipment such as an impact crusher, jaw crusher, gyratory crusher or roll crusher and by conventional screening equipment such as a shaker screen or vibrating screen to a particle size ranging in size from at least 1 micron to less than 10 mm and preferably less than 6 mm, before being fed to surface retort 90 (FIG. 10) via raw shale inlet line 93. Oil shale particles less than 1 micron should be avoided because fine particles of that size tend to clog up the retort and hinder retorting. Oil shale particles greater than 10 mm adversely affect fluidizing and retorting of smaller oil shale particles. Oil shale particles greater than 6 mm are not efficiently retorted without internals. Oil shale particles over 3 mm cannot generally be fluidized in the retort.

In fluid or fluidized bed surface retorts, an inert fluidizing gas such as light hydrocarbon gases or vaporized purified retort water which has been treated in accordance with one of the water treatment processes described above is injected upwardly into the bottom of the retort 90. Crushed oil shale particles are fed into surface retort 90 at a solids flux flow rate between 5,000 and 100,000 lbs/ft$^2$ hr. and preferably between 10,000 and 50,000 lbs/ft$^2$ hr. for best results. A solids flux flow rate over 100,000 lbs/ft$^2$ hr. should be avoided because retorting efficiency is reduced.

Solid heat carrier material, preferably spent oil shale, is fed into surface retort 90 through heat carrier line 94 at a temperature from 1000° F. to 1400° F. Spent shale in excess of 1400° F. should be avoided because it will decompose substantial quantities of carbonates in the oil shale. Spent shale below 1000° F. should be avoided, because fine removal problems are aggravated and spent shale input requirements are increased because of the high attrition rates at high recycle ratios. The ratio of solids flux flow rate of the solid heat carrier material (spent shale) being introduced into surface retort 90 to the solids flux flow rate of raw oil shale being introduced into the retort in lbs/ft$^2$ is in the range from 0.5:1 to 10:1 and preferably from 4:1 to 7:1 for more efficient retorting. Other types of solid heat carrier material, such as ceramic balls, metal balls or sand and/or gaseous heat carrier material can be used.

Surface retort 90 operates at a retorting temperature of 850° F. to 1000° F. at atmospheric pressure. In order to prevent the product oil and gases from combusting in surface retort 90, air and molecular oxygen are substantially prevented from entering the retort. In fluid or fluidized bed surface retorts, an inert fluidizing gas such as light hydrocarbon gases or vaporized purified retort water which has been treated in accordance with one of the water treatment processes described above, is injected upwardly into the bottom of the retort 90 to fluidize, mix and entrain the raw and spent oil shale particles. A series of vertical bars or other internals can also be positioned in the interior of surface retort 90 to promote mixing and heat transfer as well as to break up bubbles and reduce plugging that may result during retorting.

During retorting, an effluent product stream of shale oil, light hydrocarbon gases and oil shale retort water, is liberated from the raw oil shale as a gas, vapor, mist or liquid droplets, and most likely a mixture thereof. Particulates of raw, retorted and spent oil shale dust ranging in size from less than 1 micron to 1000 microns are entrained in the effluent product stream. Generally, the problem of entrained shale particulates are much more aggravated than from in situ retorts because of raw and spent shale mixing and shale decrepitation in surface retorting.

Retorted oil shale is discharged from surface retort 90 (FIG. 10) and conveyed by gravity flow or other conveying means to a combustor, such as a dilute phase combustion lift pipe 96. Air is injected into the bottom of lift pipe 96 by an air injector 98 to fluidize, entrain, mix, propel and convey the retorted shale upwardly to an overhead collection and separation bin 100. Carbon residue contained in the retorted shale is combusted in lift pipe 96 leaving spent shale which is transported upwardly to the collection and separation bin. The combustion heats the spent shale to a temperature of 1,000° F. to 1,400° F. Spent shale in the collection and separation bin is fed into surface retort 90 through feed line 94 for use as solid heat carrier material to retort the raw oil shale. Combustion gases and products of combustion are withdrawn from the top of the overhead collection and separation bin 100 through discharge line 102 and dedusted in a cyclone or electrostatic precipitator for discharge to the atmosphere or for further processing.

The effluent product stream of shale oil, light hydrocarbon gases and oil shale retort water vapor are discharged from the top of surface retort 90 (FIG. 10) and partially dedusted in a cyclone 104 before being separated into fractions in water sprayed, quench towers or scrubbers 106, 108 and 110. Purified retort water, which has been treated in accordance with one of the water treatment processes described above, is sprayed through feed lines 112, 114 and 116 into quench towers 106, 108 and 110, respectively, to separate the effluent product stream into fractions. Heavy shale oil having a boiling point over 600° F. to 800° F. with 1% to 50% and preferably at least 25% by weight of the entrained oil shale particulates is separated and discharged from the bottom of quench tower 106. The heavy oil depleted fraction is fed through line 118 into quench tower 108. Middle shale oil having a boiling point over 400° F. to 500° F. is separated and discharged from the bottom of quench tower 108. The middle shale oil depleted fraction is fed into quench tower 110 through line 120. Light shale oil having a boiling point over 100° F. is separated and discharged from the bottom of quench tower 110. Light hydrocarbon gases are discharged from quench tower 110 through overhead line 122 for recycling or further processing. Oil shale retort water vapors are discharged from quench tower 110 through line 124 and purified by one of the GAC or PAC water treatment processes described above.

Figure 10:
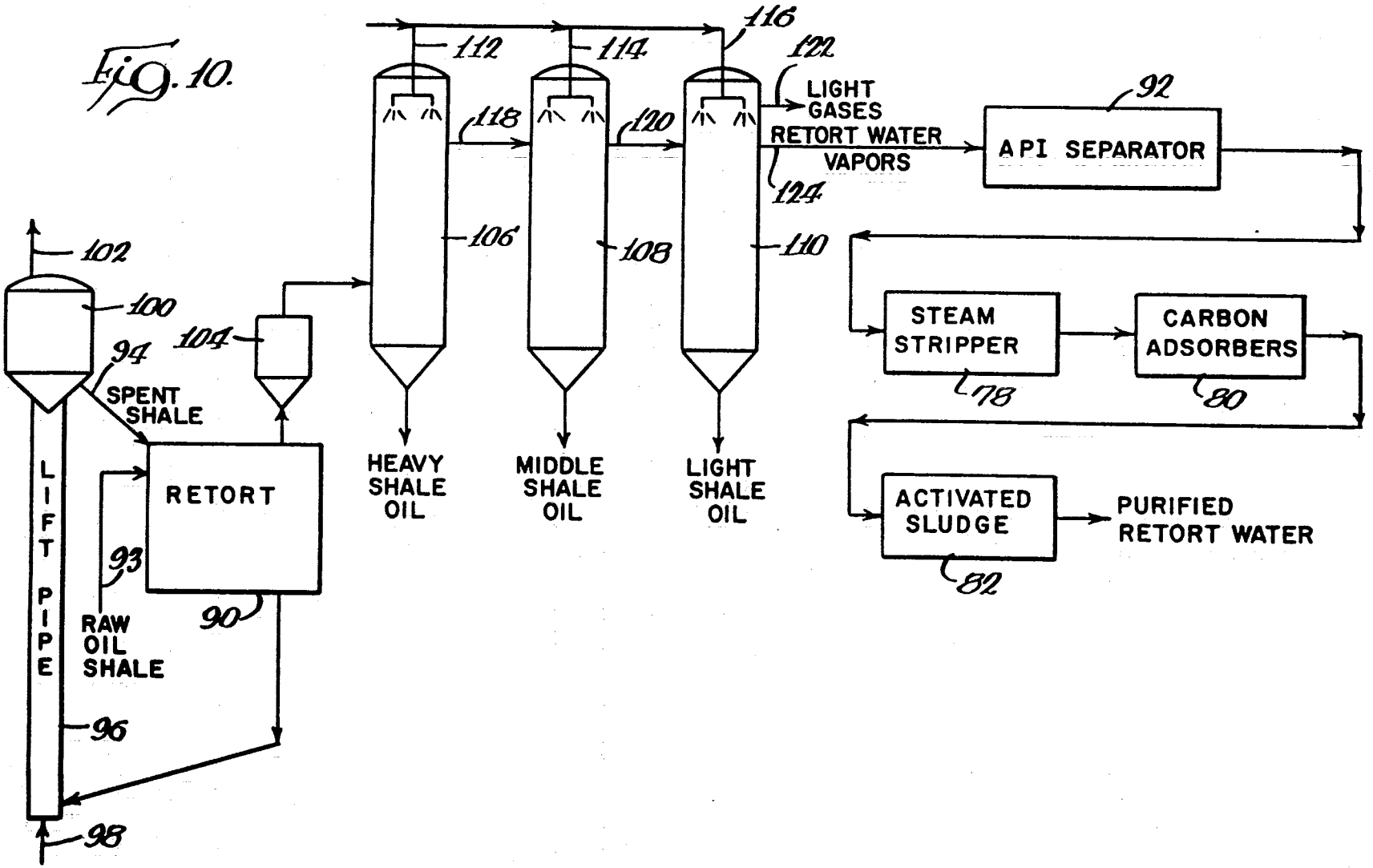
FIG. 10 is a schematic flow diagram of another surface retorting and retort water purification process in accordance with principles of the present invention.
Figure 11:
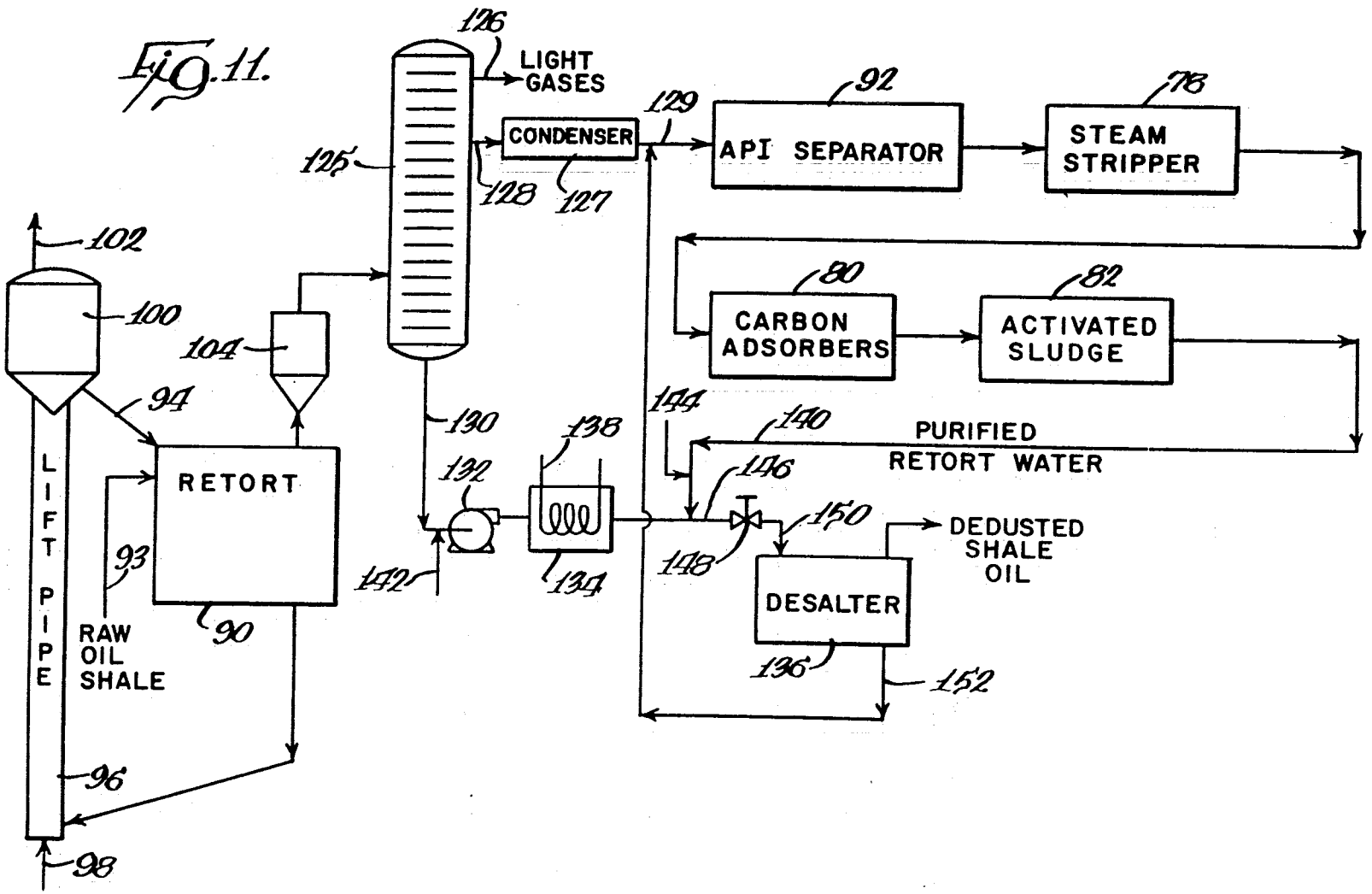
FIG. 11 is a schematic flow diagram of a further surface retorting and retort water purification process in accordance with principles of the present invention.

In FIG. 11, the effluent product stream from surface retort 90 is dedusted in cyclone 104 and separated into fractions of whole shale oil, light hydrocarbon gases and oil shale retort water vapor in fractionator 125, also referred to as a "fractionating column" or "distillation column." Light hydrocarbon gases are discharged from fractionator 125 through overhead line 126 for recycling or further processing. Oil shale retort water vapors from fractionator 125 are liquified in condenser 127 via inlet and outlet lines 128 and 129 and are purified in one of the GAC or PAC water treatment processes described above. Whole shale oil contains heavy shale oil, middle shale oil and light shale oil having the boiling ranges described in the process of FIG. 10 and is laden with 10% to 15% by weight oil shale particulates.

Particulate laden shale oil is very viscous and cannot be pipelined unless dedusted. Particulate laden shale oil plugs up hydrotreaters and catalytic crackers, gums up valves, heat exchangers, outlet orifices and pumps and builds up insulative layers on heat exchange surfaces reducing their efficiency and fouls up other equipment. Particulate laden shale oil can also corrode turbine blades and create emission problems.

In order to dedust the particulate laden shale oil, the particulate laden shale oil is withdrawn from fractionator 125 through discharge line 130 by pump 132 and cooled in a heat exchanger or cooler 134 to a temperature from 100° F. to 250° F. and preferably from 150° F. to 200° F. before being fed and dedusted in a desalter 136. Heat exchanger 134 is preferably water cooled through line 138 using purified retort water which has been treated in accordance with one of the GAC or PAC water treatment processes described above. From 10% to 50% and preferably a maximum of 30% by volume purified retort water, which has been treated in accordance with one of the GAC or PAC water treatment processes described above, is injected into the cooled particulate laden shale oil by water injection line 140 to form an emulsion. An emulsifier or surfactant such as a hydrophilic or wetting agent can be added to the particulate laden shale oil before pump 132 through additive line 142 to lower surface tension and enhance dedusting. An alkali such as caustic or soda ash, can be added to the purified retort water through auxiliary line 144 at a rate from 0.01 pounds to 5 pounds alkali per 1,000 barrels of purified retort water to keep the purified water basic so as not to absorb amines and nitrogen and to facilitate emulsion, separation and dedusting as well as to enhance removal of trace metals from the shale oil.

The emulsion of shale oil and purified retort water flows through emulsion line 146 to a mixing valve or emulsifier valve 148 where it is discharged through a coalescer line 150 to a desalter 136. The coalescer line can also include a zigzag coalescing section to further resolve the emulsion before it enters the desalter.

Desalter 136 can be an electrical desalter or a chemical desalter. The residence time in desalter 136 is from 0.5 minutes to 25 minutes and preferably from 6 minutes to 12 minutes for most efficient dedusting. The pressure in desalter 136 is about atmospheric pressure when whole shale oil is being dedusted.

Particulate laden heavy shale oil can also be emulsified with purified retort water and dedusted in desalter 136. The pressure in desalter 136 is about 25 psia to 135 psia when heavy shale oil is being dedusted. Such pressures minimize vaporization of the shale oil and purified retort water.

Desalter 136 breaks up and separates the emulsion into a purified, dedusted phase or stream of normally liquid shale oil containing only from 1,500 ppm (0.15%) to 15,000 ppm (1.5%) by weight particulates of oil shale and a particulate laden aqueous phase or dust laden water stream, also referred to as "desalter sludge." Desalter 136 is also effective in removing significant amounts of arsenic and other trace metals from the influent particulate laden shale oil.

Desalter sludge contains from 39% to 76% and preferably 65% by weight retort water, from 23 percent to 60% and preferably about 33% by weight oil shale particulates, from 0.5% to 1% and preferably 0.66% shale oil, from 0.01% to 0.1% by weight arsenic and other impurities. The dust laden water stream is removed from the bottom of desalter 136 through sludge line 152 and recycled and purified in one of the GAC or PAC water treatment processes described above.

The preferred water treatment process used with the oil shale processes of FIGS. 10 and 11 include API oil/water separation, steam stripping and GAC adsorption followed by activated sludge biological treatment. PAC activated sludge biological treatment can be used in lieu of GAC adsorption and activated sludge biological treatment. The GAC adsorbers can be of the type shown in FIGS. 2, 5 and 6. If desired, granular filtration and/or clarification or air flotation, as shown in FIGS. 2, 3 and 4, respectively, can be included in the water treatment processes.

Although embodiments of the above oil shale processes have been shown and described, it is to be understood that various modifications and substitutions, as well as rearrangements and combinations of process steps, can be made by those skilled in the art without departing from the novel spirit and scope of this invention.

What is claimed is:

1. An in situ oil shale process, comprising the steps of:

retorting raw oil shale in situ to liberate light hydrocarbon gases, shale oil and shale-laden retort water containing suspended and dissolved impurities including raw and spent oil shale particulates, shale oil, organic carbon, carbonates, ammonia and chemical oxygen demand;

separating said light hydrocarbon gases and a substantial portion of said shale oil from said shale-laden retort water by sedimentation in an underground sump;

removing a substantial portion of the remaining shale oil and a substantial portion of said suspended raw and spent oil shale particulates from said shale-laden retort water by filtering said shale-laden retort water through a granular filter;

steam stripping a substantial amount of said ammonia and carbonates from said shale-laden retort water; and carbon adsorbing and biologically treating said shale-laden retort water to remove a substantial amount of the total and dissolved organic carbon from said shale-laden retort water and simultaneously substantially lower the chemical oxygen demand of said shale-laden retort water so as to substantially purify said shale-laden retort water.

2. An oil shale process in accordance with claim 1 including clarifying and separating a substantial portion of said shale oil from said shale-laden retort water by passing said retort water through a clarifier before said filtering.

3. An oil shale process in accordance with claim 1 including separating a substantial portion of said shale oil from said shale-laden retort water by passing said retort water through an air flotation unit.

4. An oil shale process in accordance with claim 1 wherein said separating includes spraying said liberated shale oil with said purified water in a quench tower, said purified water becoming contaminated in said quench tower, said contaminated water is steam stripped, carbon adsorbed and biologically treated with said shale-laden retort water, and recycling said treated retort water for use in spraying said shale oil in said quench tower.

5. An oil shale process in accordance with claim 1 including treating said shale-laden retort water with a rotating biological contactor.

6. An oil shale process in accordance with claim 1 wherein said biological treatment includes an anaerobic process.

7. An oil shale process in accordance with claim 1 wherein said carbon adsorbing includes passing said retort water through at least one granular carbon adsorber before biologically treating said retort water.

8. An oil shale process in accordance with claim 1 wherein said carbon adsorbing and biological treatment includes passing said retort water through a tank containing powdered activated carbon and activated sludge.

9. An oil shale process, comprising the steps of:

heating a portion of a rubblized mass of raw oil shale in a retorting zone of an underground retort to a retorting temperature to liberate shale oil, light hydrocarbon gases and oil shale retort water vapors from said oil shale leaving retorted shale containing residual carbon;

combusting said residual carbon in said oil shale in a combustion zone above said retorting zone in said underground retort with a flame front to generate said heat;

injecting a flame front-sustaining, oxygen-containing, feed gas into said flame front to drive said flame front and said retorting zone generally downwardly;

condensing said water vapors on raw oil shale beneath said retorting zone to form retort water;

separating said light hydrocarbon gases and a substantial amount of shale oil from said retort water in a sump located in a tunnel communicating with the bottom of said retort;

withdrawing said separated retort water, shale oil and gases from said sump;

simultaneously removing a substantial amount of oil shale and a substantial amount of shale oil from said retort water by granularly filtering said retort water;

removing a substantial amount of ammonia and carbonates from said retort water by steam stripping said retort water; and removing a substantial amount of organic carbon from said retort water by carbon adsorbing and biologically treating said filtered water with activated sludge to substantially purify said retort water.

10. An oil shale process in accordance with claim 9 wherein said filtering, stripping, carbon adsorbing and biological treatment remove from said retort water: at least 85% to 99% by weight total organic carbon, at least 80% to 98% by weight chemical oxygen demand, at least 90% to 99% by weight ammonia and at least 90% to 99% by weight phenols.

11. An oil shale process in accordance with claim 9 wherein said purified retort water is vaporized and used as part of said feed gas.

12. An oil shale process in accordance with claim 11 wherein:

said feed gas is intermittently injected into said flame front to repetitively ignite and extinguish said flame front;

a purge gas is fed into said combustion zone between injections of said feed gas to accelerate transfer of sensible heat from said combustion zone to said retorting zone; and said purified retort water is vaporized and used as part of said purge gas.

13. An oil shale process in accordance with claim 9 wherein said separated retort water is clarified before said filtering.

14. An oil shale process in accordance with claim 9 wherein said separated retort water is processed in an air flotation unit before said filtering.

15. An oil shale process in accordance with claim 9 wherein said carbon adsorbing includes passing said retort water through at least one granular activated carbon adsorber before said biological treatment.

16. An oil shale process in accordance with claim 15 wherein said retort water is passed through a series of granular activated carbon adsorbers before said biological treatment.

17. An oil shale process in accordance with claim 9 wherein said carbon adsorbing and biological treatment includes passing said retort water through a tank containing powdered activated carbon and activated sludge.

* * * * *

UNITED STATES PATENT OFFICE
CERTIFICATE OF CORRECTION

Patent No. 4,585,063 Dated April 29, 1986

Inventor(s) VENARDOS, DEAN G. and GRIEVES, COLIN G.

It is certified that error appears in the above-identified patent and that said Letters Patent are hereby corrected as shown below:

| PATENT Column | Line | |
|---|---|---|
| 3 | 27 | "Retortinq" should be --Retorting-- |
| 3 | 27 | "Oil Shal" should read --Oil Shale-- |
| 8 | 58 | "Gasses from" should read --purge gas is from-- |
| 9 | 4 | "12,000 mg/" should read --12,000 mg/l-- |
| 9 | 5 | "1,800 mg/" should read --1,800 mg/l-- |
| 9 | 5 | "7,000 mg/" should read --7,000 mg/l-- |
| 9 | 6 | "15,000 mg/" should read --15,000 mg/l-- |
| 9 | 6-7 | "1,600 mg/" should read --1,600 mg/l-- |
| 9 | 7 | "7 mg/" should read --7 mg/l-- |
| 9 | 8 | "5 mg/" should read --5 mg/l-- |
| 16 | 44 | "are" should be --is-- |
| 20 | 59 | after "passed" add --substantially upwardly-- |

Signed and Sealed this

Twenty-third Day of December, 1986

*Attest:*

DONALD J. QUIGG

*Attesting Officer* *Commissioner of Patents and Trademarks*